US005142512A

United States Patent [19]

Takano et al.

[11] Patent Number: 5,142,512

[45] Date of Patent: Aug. 25, 1992

[54] CLOCK WITH DECORATIVE COVER SHEET

[75] Inventors: Motonobu Takano; Yoshio Iseki, both of Tokyo, Japan

[73] Assignee: Seikosha Co., Ltd., Japan

[21] Appl. No.: 674,690

[22] Filed: Mar. 22, 1991

[30] Foreign Application Priority Data

Mar. 24, 1990 [JP] Japan ..... 2-30312[U]

[51] Int. Cl.[5] ..... G04B 19/06; G04B 37/00

[52] U.S. Cl. ..... 368/232; 368/276; 368/285

[58] Field of Search ..... 368/88, 228, 276, 285, 368/309, 232

[56] References Cited

U.S. PATENT DOCUMENTS 3,853,216 12/1974 Jaeschke ..... 368/276

3,889,806 6/1975 Casella ..... 368/285

*Primary Examiner*—Vit W. Miska

*Attorney, Agent, or Firm*—Bruce L. Adams; Van C. Wilks

[57] ABSTRACT

A clock having: a casing encasing a timepiece movement; and a decorative cover sheet. The cover sheet covers the casing while being folded along fold lines. A design is depicted on at least a sheet front piece. A cutout corresponding to a dial receiver portion is used as a dial. A continuity in design is provided between the dial and the cover sheet.

13 Claims, 3 Drawing Sheets

CLOCK WITH DECORATIVE COVER SHEET

BACKGROUND OF THE INVENTION

1. Field of the Invention

The present invention is directed to a clock equipped with an arbitrarily designed decorative cover sheet.

2. Description of the Prior Art

Timepiece technology has recently been developed to diversify the timepieces and reduce the costs thereof. Applications of the timepieces are spreading over ranging from durable consumer goods to ordinary consumer goods. More specifically, the timepiece is offered for its main purpose of providing a time signal function. In addition, timepieces are also offered for a variety of applications in which they are attached to ornaments, wall decorations or goods such as furnitures and bags, or they are available as gifts.

The following is a description of one example. Depicted on an outer surface of a clock casing are arbitrary designs such as trademarks of drinks, cigarettes, scenes of tourist resorts and characters of popular cartoons. In this case, a pattern is printed directly on the casing, and at the clock same time the dial is manufactured from a separate member.

In this manner, the pattern is printed directly on the clock casing. On the clock other hand, the dial involves the use of separately manufactured member. This process presents such a problem that a discontinuity in design exists between the casing and the dial. In the case of manufacturing the clocks assuming the same configuration but with different designs, a print mask is newly prepared and reformed for each different casing. This results in an increase in costs.

SUMMARY OF THE INVENTION

It is an object of the present invention to provide an inexpensive clock exhibiting a continuity in design between an exterior cover and a dial.

To accomplish this object, according to one aspect of the invention, there is provided a clock comprising: a casing encasing a timepiece movement; and a decorative cover sheet integrally formed of a single sheet and covering an outer surface of the casing so that the sheet is folded in a box-like shape along fold lines thereof, characterized in that the decorative cover sheet has an arbitrary design depicted on at least a front piece thereof, a part corresponding to a dial-receiving portion of the casing is cut out for use as a dial on the dial receiving portion, and the dial and the decorative cover sheet exhibit a continuity in terms of design.

The dial involves the use of a cutout of the decorative cover sheet, which corresponds to the dial receiving portion. In this manner, the continuity in design between the decorative cover sheet and the dial can be obtained.

BRIEF DESCRIPTION OF DRAWINGS

Other objects and advantages of the invention will become apparent during the following discussion taken in conjunction with the accompanying drawings, in which.

DESCRIPTION OF THE PREFERRED EMBODIMENT

One embodiment of this invention will hereinafter be described with reference to the accompanying drawings.

Figure 1:
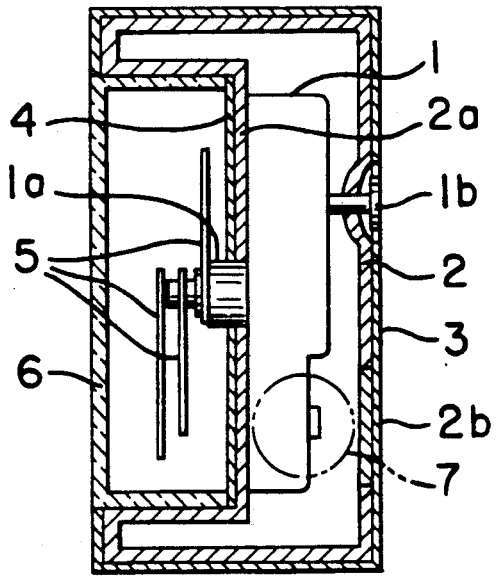
FIG. 1 is a sectional view showing one embodiment of the present invention.

According to the present invention, as illustrated in FIG. 1, a casing 2 accommodates a timepiece movement 1. A decorative cover sheet 3 covers an outer surface of the casing 2. A dial 4 involves the use of a cutout obtained by cutting a part corresponding to a dial-receiving portion 2*a* out of the decorative cover sheet 3.

Figure 2:
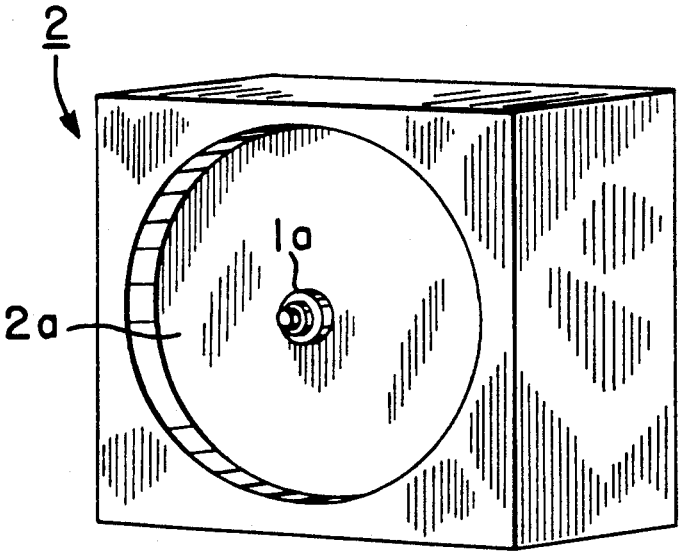
FIG. 2 is a perspective view illustrating a casing, wherein hands and a front cover are omitted.

The casing 2 is, as shown in FIG. 2, composed of a plastic molding with no pattern. The front face thereof is recessed, thus forming the dial receiving portion 2*a* which lies in a different plane than the remaining portion of the front face. A hand shaft 1*a* protrudes from the center of the dial receiving portion 2*a*. The hand shaft 1*a* is rotationally driven by the timepiece movement 1. The dial 4, which will be mentioned later, is pasted to the front surface of the dial receiving potion 2*a*.

Figure 3:
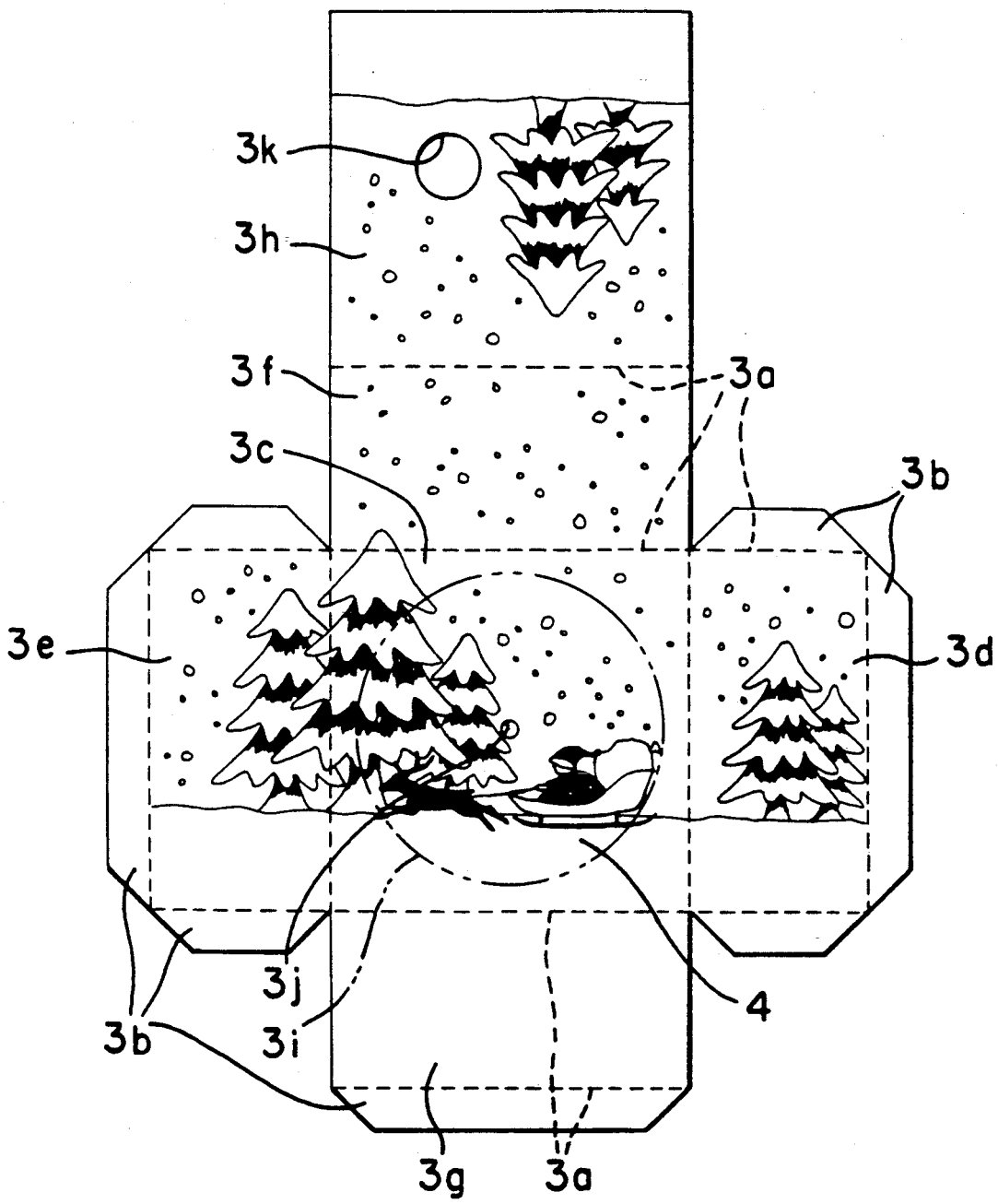
FIG. 3 is a developed view showing a decorative cover sheet.

The decorative cover sheet 3 is, as depicted in FIG. 3, composed of a single sheet the outer periphery of which is cut out to assume a configuration adaptive to the outer surface of the casing 2. This sheet is bendable along the respective edge lines of the casing 2. For this purpose, a front piece 3*c* is formed in continuation from a right side piece 3*d*, a left side piece 3*e*, a top piece 3*f* and a bottom piece 3*g* through fold lines 3*a* . . . indicated by broken lines. The top piece 3*f* is formed in continuation from a rear piece 3*h*. The sheet is formed with overlap widths 3*b* . . . necessary for bonding. The overlap widths 3*b* . . . are formed along the peripheries of the side pieces, 3*d*, 3*e* and the bottom piece 3*g* fitted to the casing 2. A decorative design such as a pictorial illustration is provided on the front piece 3*c* and the side pieces 3*d*, 3*e* of the sheet, wherein Santa Claus rides on a sleigh pulled by a reindeer in the snow scene. A scene is inversely depicted on the rear piece 3*h* so that trees covered with the snow appear in the normal posture when attaching the rear piece 3*h* to the rear face of the casing 2. Formed corresponding to the shape of the dial receiving portion 2*a* is a circular cutting line 3*i* having a size matching with the outer periphery of the dial receiving portion 2*a*. An interior of this cutting line 3*i* serves as the dial 4. The center of the dial 4 is bored with a hole 3*j* through which the hand shaft 1*a* is allowed to pass. A hand rotating hole 3*k* is formed in the rear piece 3*h*.

Figure 4:
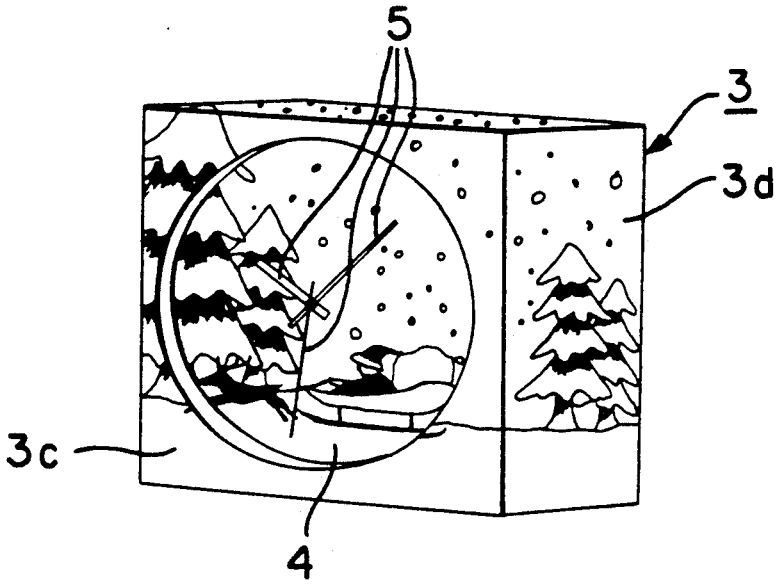
FIG. 4 is a perspective view illustrating a complete product of this invention.

As explained earlier, the integrally formed decorative cover sheet 3 is arranged as follows. The window hole is formed by cutting along the cutting line 3*i* of the front piece 3*c*. Simultaneously, the dial 4 is obtained from the cutout. The front piece 3*c* of the decorative cover sheet 3 is positioned at the front face of the casing 2. The cover sheet 3 covers the outer surface of the casing 2 and is folded along the fold lines 3*a* . . . The overlap widths 3*b* are pasted, whereby the outer surface of the casing 2 is completely covered with the decorative cover sheet 3. Subsequently, the dial 4 is pasted to the front surface of the dial receiving portion 2*a* of the casing 2. Time indicating members such as hands 5 are secured to the hand shaft 1*a*. A front cover 6 is fixed on the casing 2, thus completing the assembly. In this manner, as illustrated in FIG. 4, a clock exhibiting a three-dimensionally designed scene is fabricated. A continuity in design is thus provided between the front portion of the decorative cover sheet 3 and the dial 4.

The casing 2 encases a battery 7 replaceable via a batter cover 2*b*. A hand rotating knob 1*b* is provided on the rear surface of the casing 2. The knob 1*b* projects outside from the hole 3*k* of the decorative cover sheet 3.

In accordance with this embodiment, the front piece 3*c* is formed in continuation from the right and left side pieces 3*d*, 3*e*, the top piece 3*f* and the bottom piece 3*g* through the fold lines 3*a*. . . The top piece 3*f* is formed in continuation from the rear piece 3*h* therethrough. The respective pieces with the fold lines 3*a*. . . are not limited to this configuration. Any combinations may be used on condition that box-like folding is attainable along the fold lines 3*a*. . .

Figure 5A:
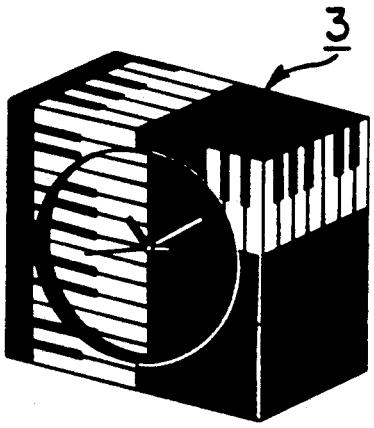
FIG. 5(*a–b*) is a perspective view showing examples of clocks with other designs.
Figure 5B:
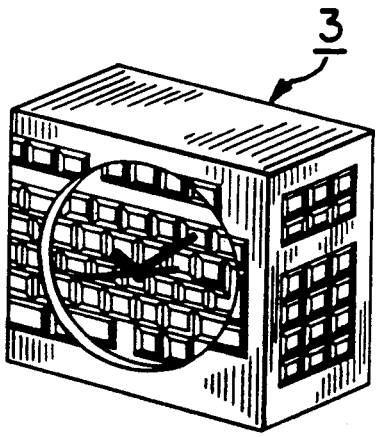

Arbitrary designs of the decorative cover sheet 3 of this invention other than the above-mentioned are usable. For instance, FIG. 5(*a*) illustrates a decorative design of a piano keyboard. FIG. 5(*b*) illustrates a decorative design of a computer keyboard.

If the battery replacement is not required, the battery take-out port may not be formed in the rear surface of the decorative cover sheet 3. As shown in this embodiment, however, the battery take-out port formed in the rear surface of the cover sheet 3 makes the battery replaceable as well as permitting a long-term use.

As discussed above, according to this invention, when shaping the decorative cover sheet, the part corresponding to the dial receiver portion is cut out part. The cutout is employed directly as the dial. With this arrangement, the continuity in design can be provided between the decorative cover sheet and the dial. The use of the decorative cover sheet eliminates the necessity for newly preparing the casing when manufacturing clocks assuming the same configuration but with different designs. The clocks with different designs can be inexpensively manufactured in the same configuration.

Although the illustrative embodiment of this invention has been described in detail with reference to the accompanying drawings, it is to be understood that the present invention is not limited to this embodiment. Various changes or modifications may be effected therein by one skilled in the art without departing from the scope or spirit of the invention.

What is claimed is:

1. A decorative clock comprising: a casing having a front face, the front face having a dial-receiving portion; a clock movement housed in the casing; time-indicating means disposed in front of the dial-receiving portion and connected to be driven by the clock movement for indicating time; and a decorative cover sheet covering the outer surface of the casing, the cover sheet having a cut-out in the region overlying the dial-receiving portion of the casing front face, the cut-out portion of the cover sheet being attached to the dial-receiving portion to define the dial of the clock.

2. A decorative clock according to claim 1; wherein the cut-out portion of the cover sheet has the same shape as that of the dial-receiving portion of the casing front face.

3. A decorative clock according to claim 1; wherein the decorative cover sheet has a decorative design which extends over the front face of the casing, and the cut-out portion of the cover sheet has a continuation of the decorative design.

4. A decorative clock according to claim 3; wherein the dial-receiving portion of the casing front face lies in a different plane than the remaining portion of the casing front face.

5. A decorative clock according to claim 4; wherein the dial-receiving portion of the casing front face is recessed relative to the remaining portion of the casing front face.

6. A decorative clock according to claim 3; wherein the cut-out portion of the cover sheet has the same shape as that of the dial-receiving portion of the casing front face.

7. A decorative clock according to claim 3; wherein the casing has a rear face opposite the front face, a top face, a bottom face and a pair of opposed side faces; and wherein the decorative design of the decorative cover sheet extends continuously without interruption from the front face over at least the pair of side faces or over the top face.

8. A decorative clock according to claim 7; wherein the decorative design of the decorative cover sheet extends continuously without interruption from the front face over the pair of side faces, the top face and the rear face.

9. A decorative clock according to claim 7; wherein the dial-receiving portion of the casing front face lies in a different plane than the remaining portion of the casing front face.

10. A decorative clock according to claim 7; wherein the decorative cover sheet comprises a single sheet folded and attached to the outer surface of the casing.

11. A decorative clock according to claim 1; wherein the decorative cover sheet comprises a single sheet folded and attached to the outer surface of the casing.

12. A method of producing a decorative clock, comprising the steps;

providing a clock casing having a front face which has a dial-receiving portion and housing therein a clock movement;

providing a decorative cover sheet configured to be folded so as to cover the outer surface of the clock casing;

cutting out a portion of the decorative cover sheet corresponding to the dial-receiving portion of the clock casing;

folding the decorative cover sheet to cover the outer surface of the clock casing with the cut-out thereof overlying the dial-receiving portion and attaching the folded cover sheet to the clock casing;

attaching the cut-out portion of the decorative cover sheet to the dial-receiving portion of the clock casing to define the clock dial; and connecting time-indicating members to the clock movement so that the time-indicating members may be driven by the clock movement in front of the clock dial to indicate time.

13. A method according to claim 12; wherein the step of providing a decorative cover sheet comprises providing a decorative cover sheet having a decorative design; and the step of attaching the cut-out portion comprises attaching the cut-out portion of the decorative cover sheet so that the decorative design thereon forms a continuation of the decorative design on the remainder of the decorative cover sheet.

* * * * *